US007111739B2

(12) United States Patent
Tsutsumi

(10) Patent No.: US 7,111,739 B2
(45) Date of Patent: Sep. 26, 2006

(54) WET FINE PARTICLE SIZING AND SEPARATING APPARATUS

(75) Inventor: Masataka Tsutsumi, Canton, OH (US)

(73) Assignee: Sizetec, Inc., Canton, OH (US)

( * ) Notice: Subject to any disclaimer, the term of this patent is extended or adjusted under 35 U.S.C. 154(b) by 383 days.

(21) Appl. No.: 10/626,927

(22) Filed: Jul. 25, 2003

(65) Prior Publication Data

US 2004/0016682 A1 Jan. 29, 2004

Related U.S. Application Data

(60) Provisional application No. 60/398,819, filed on Jul. 26, 2002.

(51) Int. Cl.
*B07B 1/28* (2006.01)

(52) U.S. Cl. ..... 209/315; 209/317; 209/254

(58) Field of Classification Search ..... 209/311, 209/313–317, 243, 247, 254, 922, 253; 198/452, 198/435

See application file for complete search history.

(56) References Cited

U.S. PATENT DOCUMENTS 35,916 A * 7/1862 Beach ..... 209/247
281,655 A * 7/1883 Wilson ..... 209/344
1,052,946 A * 2/1913 Otis ..... 209/355
2,191,923 A * 2/1940 Cecka ..... 209/315
3,439,800 A * 4/1969 Tonjes ..... 209/3
3,669,265 A * 6/1972 Conley ..... 209/135
3,688,902 A * 9/1972 Hubach ..... 209/240
3,779,381 A * 12/1973 Armstrong ..... 209/271
3,819,050 A * 6/1974 Lower ..... 209/254
3,826,367 A * 7/1974 Hubach ..... 209/243
3,899,414 A * 8/1975 Hansen ..... 209/17
4,065,382 A * 12/1977 Derrick, Jr. ..... 209/313
4,097,382 A * 6/1978 Cruea ..... 210/456
4,113,626 A * 9/1978 Detcher ..... 210/409
4,155,840 A * 5/1979 Gauld et al. ..... 209/245
4,224,138 A * 9/1980 Kruyer ..... 208/391
4,231,861 A * 11/1980 Hannie et al. ..... 209/240
4,234,416 A * 11/1980 Lower et al. ..... 209/247
4,276,158 A * 6/1981 Gorlitz ..... 209/255
4,384,952 A * 5/1983 Parsons et al. ..... 209/255
4,390,420 A * 6/1983 Tenhaaf ..... 209/403
4,443,332 A * 4/1984 de Nevers ..... 209/331

(Continued)

FOREIGN PATENT DOCUMENTS

GB 2276338 A * 9/1994

(Continued)

OTHER PUBLICATIONS

Advertisement, Introducing the Derrick Stack Sizer, TMIM, Aug. 2002, p. 13.

(Continued)

*Primary Examiner*—Gene O. Crawford
*Assistant Examiner*—Matthew J. Kohner
(74) *Attorney, Agent, or Firm*—Buckingham, Doolittle & Burroughs, LLP.; David P. Dureska; Edward T. Kennedy

(57) ABSTRACT

A particle sizing and separating apparatus is disclosed. The apparatus includes a base and a frame that is movably connected to the base. A motor assembly is provided to vibrate the frame and at least two screens are connected to the frame. Means also are provided for feeding particles to each screen from two opposing sides of each screen and for evenly distributing the particles onto the screens. A pan is disposed beneath each screen to receive sized particles that pass through the screens and an outlet receives oversize particles that pass over the screens.

5 Claims, 5 Drawing Sheets

U.S. PATENT DOCUMENTS 4,576,713 A * 3/1986 Melin ..... 209/254
4,613,432 A * 9/1986 Racine et al. ..... 209/254
4,683,061 A * 7/1987 Carroll ..... 210/512.1
4,689,140 A * 8/1987 Folsberg ..... 209/139.2
4,814,071 A * 3/1989 Lower ..... 209/243
4,826,017 A * 5/1989 Du Bourg et al. ..... 209/234
4,836,385 A * 6/1989 Slesarenko et al. ..... 209/315
4,839,036 A * 6/1989 Slesarenko ..... 209/315
4,855,039 A * 8/1989 Genev ..... 209/311
4,940,535 A * 7/1990 Fisher et al. ..... 209/250
5,279,425 A * 1/1994 Botos ..... 209/315
5,336,408 A * 8/1994 Tsutumi ..... 210/384
5,337,901 A * 8/1994 Skaer ..... 209/315
5,431,287 A * 7/1995 Knox ..... 209/250
5,593,582 A * 1/1997 Roff, Jr. ..... 210/325
5,614,094 A * 3/1997 Deister et al. ..... 210/388
5,749,471 A * 5/1998 Andersson ..... 209/314
5,769,239 A * 6/1998 Thom et al. ..... 209/240
5,853,583 A * 12/1998 Shah ..... 210/340
5,921,400 A * 7/1999 Judd ..... 209/287
6,431,366 B1 8/2002 Fallon
6,505,743 B1 * 1/2003 Bandis ..... 209/173
6,820,748 B1 * 11/2004 Fallon ..... 209/311

FOREIGN PATENT DOCUMENTS

JP 01062426 A * 3/1989
WO WO 9104802 A * 4/1991

OTHER PUBLICATIONS

Web site www.derrickcorp.com/products/wetsizing/stacksizer.htm, Products, Wet Sizing/Dewatering, Derrick Stack Sizer, Jul. 1, 2003, pp. 1-3.
Derrick Corporation, brochure, Stack Sizer, 2002, entire document.

* cited by examiner

WET FINE PARTICLE SIZING AND SEPARATING APPARATUS

CROSS REFERENCE TO RELATED APPLICATION

This application claims the benefit of U.S. Provisional Application Ser. No. 60/398,819, filed on Jul. 26, 2002.

BACKGROUND OF THE INVENTION

1. Field of the Invention

The invention relates to the art of sizing and separating solids from a liquid or slurry. More particularly, the invention relates to the art of screening particulate materials by utilizing motorized means to cause a screening apparatus to vibrate and lead to greater efficiency of separation.

2. Description of Related Art

Wet fine particle sizing and separating apparatus have been used to size and separate particles having a size of from about 8 mesh (3 mm) to about 400 mesh (38 microns). These apparatus have been utilized in grinding mills in the separation of gangue from heavy minerals such as iron ore, tin, and the like, and also in residue removal from kaolin slurry.

Most prior art wet fine sizing and separating apparatus have utilized only one or two screens disposed horizontally or at a slight incline, with the screens being housed in a relatively large apparatus. The large apparatus take up valuable processing space, while the use of only one or two screens limits the capacity of material that can be processed.

Attempts have been made to solve the longstanding problems of large apparatus size and limited capacity by vertically stacking several screens within a single apparatus. In this configuration, each screen independently sized and separated material. However, the prior art apparatus fed the material onto each screen through only a single inlet. Deflectors were used adjacent to and above the screens in an attempt to evenly distribute the material on the screens. Since the fine particles being processed were wet, feeding the material onto the screen via a single inlet failed to result in optimal spreading of the material over the screen, reducing the efficiency and effectiveness of the sizing and separating operation.

Accordingly, it is desirable to develop an apparatus for wet fine particle sizing and separating, which overcomes the disadvantages of the prior art and exhibits increased capacity in a compact assembly.

SUMMARY OF THE INVENTION

Objectives of the present invention include providing an apparatus for the sizing and separating of wet fine particles having increased capacity, while remaining relatively compact.

In accordance with an exemplary embodiment of the invention, a frame is movably connected to a base and a motor assembly is provided to vibrate the frame. At least two screens are secured in a screen box which is connected to the frame. Particulate material is fed to each screen from two opposing sides of each screen. A spreader tray is disposed above each screen in the screen box and the particulate material is fed through opposing inlet ports defined in the screen box, onto each spreader tray and onto an end of each screen adjacent to the respective opposed inlet ports.

Conveyance means, such as a hose, delivers the particulate material to the inlet ports in the screen box. The conveyance means connects a distributor to the inlet ports.

The distributor is high capacity and includes an inlet pipe through which it receives particulate material, and at least two outlet ports that are in fluid communication with the conveyance means. The number of outlet ports defined by the distributor corresponds to the number of inlet ports of the screen box. More particularly, the conveyance means connect each outlet port of the distributor to each corresponding inlet port of the screen box. Thus, particulate material is received by the distributor and passes through the outlet ports and the communication means to the inlet ports in the screen box. As noted, the screen box defines an inlet port on each of two opposing sides of each spreader tray to allow particulate material to be delivered to both sides of each tray for uniform distribution.

As the motor assembly causes the frame and its associated components to vibrate, including the screen box, spreader trays and screens, the particulate material responds to the vibratory motion by moving across the spreader trays and the screens. The spreader trays define perforations through which the particulate material passes, allowing a relatively gentle and even distribution of particles onto each screen. The screens are of a mesh that is dictated by the particular application. Particles that are undersized pass through the screens with any liquid, while oversize particles pass across the surface of the screens.

A pan is disposed beneath each screen to receive the particles that pass through the screen corresponding to the pan. A discharge system, such as at least one tube, is in fluid communication with each pan and all of the pans are shaped to convey the undersize particles to the tube. A hopper is included in a lower portion of the screen box and receives oversize particles that pass across the surface of the screens as the screens are vibrated. The oversize particles drop off the end of each screen and to the hopper, which defines an outlet. The oversize particles pass through the outlet and are conveyed away from the apparatus.

The apparatus includes a plurality of screens, such as five screens. The screens are arranged in a spaced parallel manner and are generally vertically aligned with one another.

BRIEF DESCRIPTION OF THE DRAWINGS

The preferred embodiments of the present invention, illustrative of the best mode in which applicant has contemplated applying the principles, are set forth in the following description and are shown in the drawings, and are particularly and distinctly pointed out and set forth in the appended claims.

Similar numerals refer to similar parts throughout the drawings.

DETAILED DESCRIPTION OF THE PREFERRED EMBODIMENT

The invention includes a compact apparatus in which at least two screens are each fed from two opposing sides with material to be sized and separated, providing an effective and efficient distribution of wet particles as the particles collide and disperse on a perforated spreader tray disposed above each screen. In addition, the screens are arranged in parallel. For example, five horizontally-oriented screens may be stacked vertically and spaced apart from one another in a parallel manner.

As the screens are vibrated by motors, the wet material is evenly distributed by each spreader tray on its respective screen, and the material moves along each screen on which it has been fed and small sized particles pass through the screen to a pan that is connected to discharge tubes that convey the small particles away. Large particles do not pass through the screen and instead pass along the length of each respective screen and drop off the end of the screen to fall to a hopper, which leads to an outlet that allows the large particles to be conveyed away.

Figure 1:
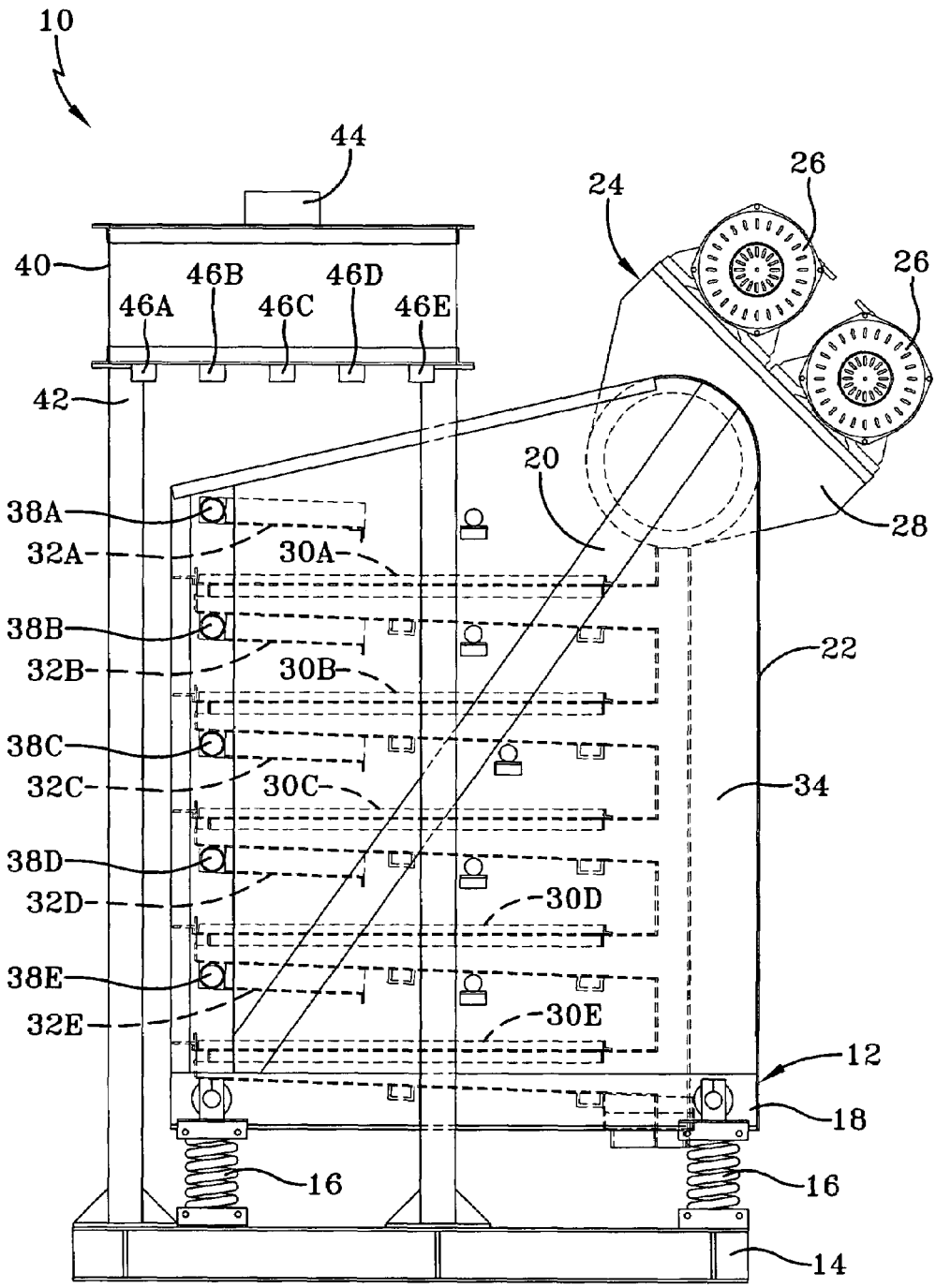
FIG. 1 is an elevational side view of a screening apparatus in accordance with a first embodiment of the present invention, with hidden parts represented by broken lines.

Referring now to the drawings, where the showings are for purposes of illustrating preferred embodiments of the invention and not for purposes of limiting the same, FIG. 1 shows a side view of the apparatus 10 of the present invention. A frame 12 is movably connected to a base or stand 14. The connection is provided by suspension means 16 as known in the art, such as a plurality of springs, elastomeric blocks, or straps, etc.

Frame 12 includes a horizontal member 18 and an angular member 20. The angular member 20 is connected to the horizontal member 18 at an angle suitable for the particular separating and screening application, such as 45 degrees. A screen box 22 is rigidly connected to horizontal frame member 18 and angular frame member 20. A motor assembly 24 to vibrate apparatus 10, including frame 12 and screen box 22, is connected to frame 12 at an upper end of angular frame member 20. Motor assembly 24 includes at least one motor 26, a housing 28 and other connection components as known in the art. The connection of motor assembly 24 to angular frame member 20, which is located at a specific angle, e.g., 45 degrees, works to create the optimum motion of screen box 22 for the separating and screening process.

Secured within screen box 22 are at least two screens 30. Screens 30 may be any style known in the art, including known materials and mesh sizes. A plurality of screens 30 may be present, and five, 30A–30E, are shown as an example. In this exemplary embodiment, screens 30A–30E are generally horizontally oriented, i.e., at an angle of about zero degrees relative to horizontal. Moreover, they are arranged in a spaced parallel manner, approximately vertically aligned with one another. Screens 30A–30E preferably are pretensioned, as known in the art, and may range in size, also as known in the art. For example, screens 30A–30E may optionally be sized at four feet wide by four feet long.

Figure 4:
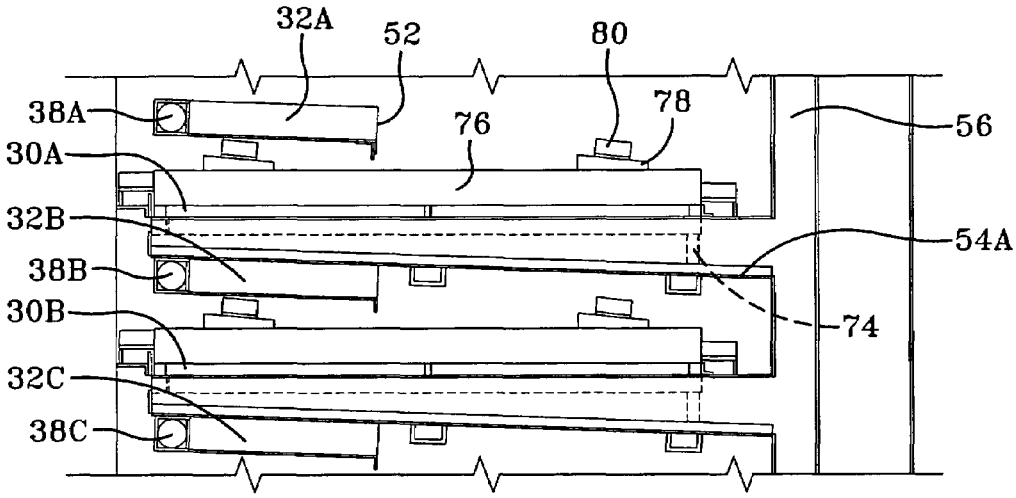
FIG. 4 is an enlarged fragmentary elevational side view of a portion of the apparatus of FIG. 1, with hidden parts represented by broken lines.
Figure 5:
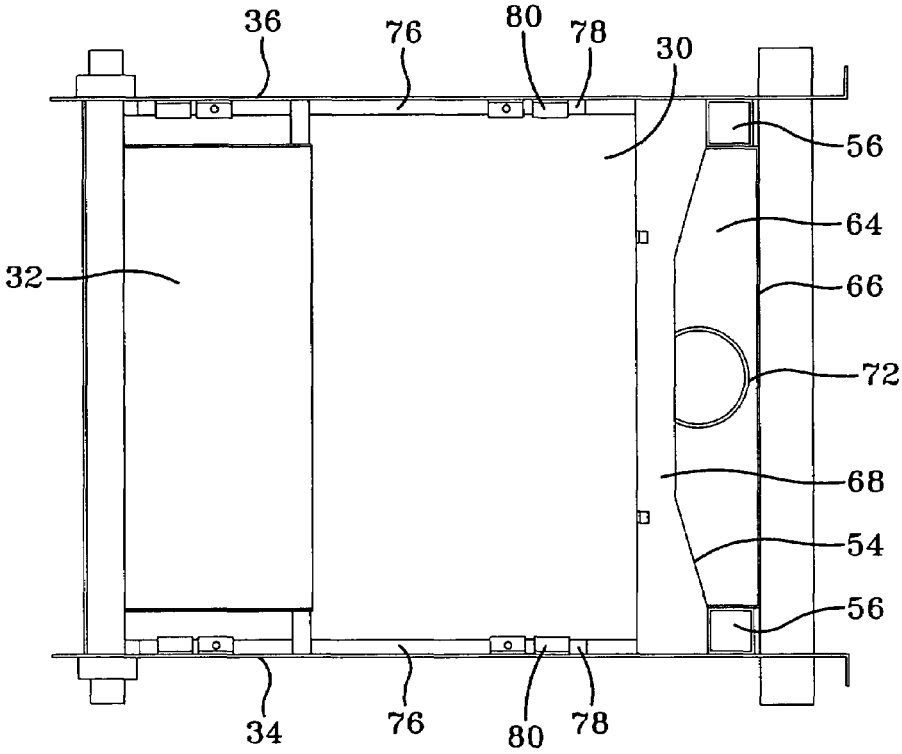
FIG. 5 is a top plan view of a portion of the apparatus of FIG. 1.

With reference to FIGS. 4 and 5, the connection of exemplary screens 30A and 30B to screen box 22 is shown. Each screen 30A and 30B rests on at least one member 74 that is secured to opposing sides 34 and 36 of the screen box 22, as known in the art, or to a pan 54 that is disposed below each screen 30, as will be described below, and is in turn secured to screen box 22. Screens are secured in place from the top using sidebars 76 that are clamped down using wedges 78 and toggles 80. All or part of at least one of sidebars 76, wedges 78 and toggles 80 may employ an elastomer to dampen the vibratory motion of screen box 22 and prolong the life of the components.

Returning now to FIG. 1, in accordance with one of the important features of the present invention, directly above each screen 30A–30E is a respective spreader tray 32A–32E. Spreader tray 32A–32E defines a plurality of perforations with an exemplary diameter of one-eighth of an inch (not shown). Each spreader tray 32A–32E is also connected to screen box 22. In particular, each spreader tray 32A–32E may be affixed directly or via supports (not shown) to opposing sides 34 and 36 (referring to FIG. 2) of screen box 22. Each spreader tray 32A–32E extends the entire width or nearly the entire width of its respective screen 30A–30E.

Figure 2:
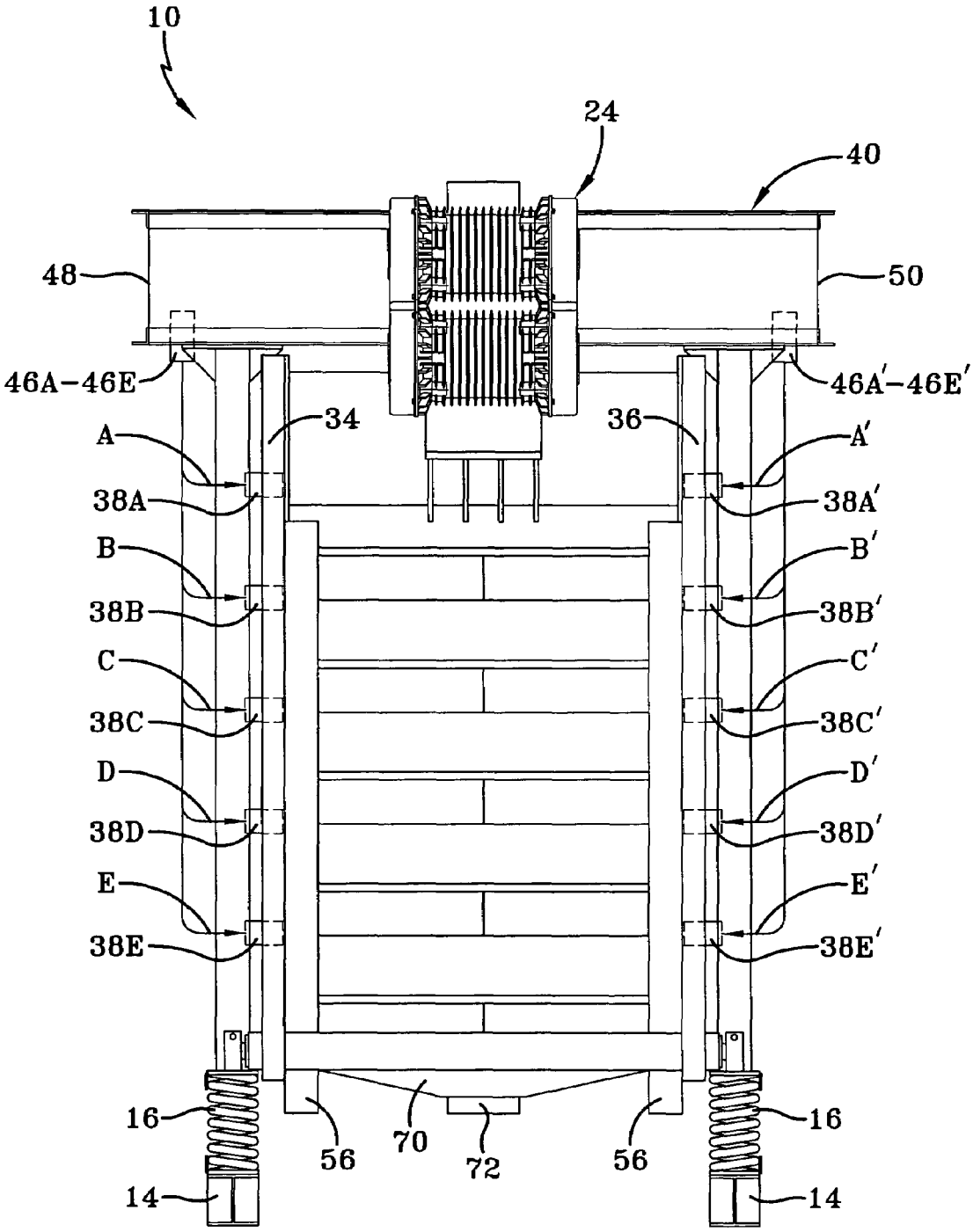
FIG. 2 is an elevational end view of the apparatus of FIG. 1, again with hidden parts represented by broken lines.

With additional reference to FIG. 2 and in accordance with another feature of the present invention, inlet ports 38A–38E and 38A'–38E' are defined in opposing sides 34 and 36, respectively, of screen box 22. Specifically, one pair of opposed inlet ports, e.g., 38A and 38A', is disposed proximate to its corresponding spreader tray, e.g., 32A. Each screen 30A–30E includes a feed end 60A–60E (referring to FIG. 3) that is underneath each respective spreader tray 32A–32E, which in turn is underneath each respective pair of inlet ports 38A–38E and 38A'–38E' to receive material flowing through inlet ports 38A–38E and 38A'–38E'.

Proximate screen box 22 is a distributor 40. Distributor 40 is mounted above screen box 22 by supports 42 that are connected to base 14. Distributor 40 includes an inlet pipe 44 and at least two outlet ports 46A–46E. A plurality of outlet ports 46A–46E and 46A'–46E' are present, as shown. Generally, each outlet port 46A–46E and 46A'–46E' corresponds to a respective inlet port 38A–38E and 38A'–38E' in screen box 22. In particular, outlet ports 46A–46E are present on one side 48 of distributor 40, while additional outlet ports 46A'–46E' are included on an opposing side 50 of distributor 40. As mentioned above, each outlet port 46A–46E and 46A'–46E' corresponds to an inlet port 38A–38E and 38A'–38E' defined in opposing sides 34 and 36 of screen box 22. Thus, distributor 40 receives a high volume of particulate material and disperses it in smaller portions for relatively uniform and consistent feeding of inlet ports 38A–38E and 38A'–38E'.

It should be noted that distributor 40 optionally includes a flow control system (not shown), as known in the art, to control distribution of particulate material to inlet ports 38A–38E and 38A'–38E'. For example, each outlet port 46A–46E and 46A'–46E' may include a valve or metering device, again as known in the art, to facilitate control over the balance and the volume of material exiting distributor 40. As a result, the feed of particulate material to inlet ports 38A–38E and 38A'–38E' from distributor 40 can be adjusted for a particular sizing and separating application.

Facilitating fluid communication between each outlet port 46A–46E and 46A'–46E' of distributor 40 and each corresponding inlet port 38A–38E and 38A'–38E' of screen box 22 are flexible conveyance or deliverance means, designated diagrammatically by arrows A–E and A'–E'. The flexible conveyance means include hoses, tubes, flexible pipes or other resilient hollow members of various diameters, depending on the application, which may be connected at one end to an outlet port, such as 46A, and connected at the other end to a corresponding inlet port, i.e., 38A. When hoses of rubber are used, the hoses preferably have a diameter of about 2½ inches.

Thus, incoming wet particulate material enters distributor 40 through inlet pipe 44 and is fed, such as by gravity flow, through distributor 40 and through outlet ports 46A–46E and 46A'–46E'. The wet particulate material passes through conveyance means A–E and A'–E', and is thus fed to corresponding inlet ports 38A–38E and 38A'–38E' in screen box 22. Screen box 22 vibrates or moves in a pre-determined pattern as dictated by motor assembly 24, frame 12 and suspension means 16, encouraging the wet particulate material to flow through conveyance means A–E and A'–E' to inlet ports 38A–38E and 38A'–38E'.

Figure 3:
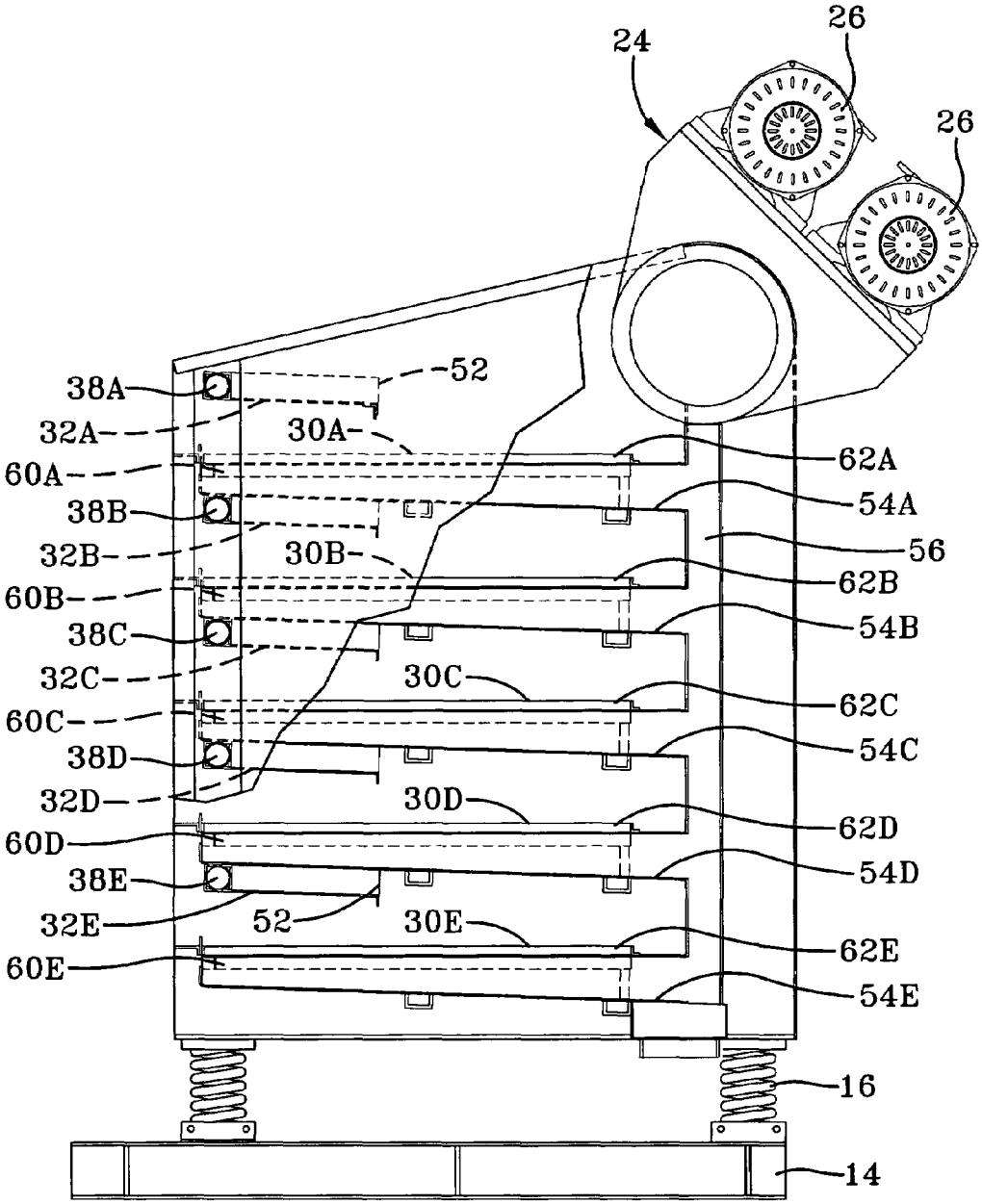
FIG. 3 is an elevational side view, with a portion broken away and hidden parts represented by broken lines, of a portion of the apparatus of FIG. 1.

Turning now to FIGS. 3–5, the wet material passes through inlet ports 38A–38E (and 38A'–38E', as shown in FIG. 2) and onto a respective spreader tray 32A–32E that is directly beneath each port 38A–38E and 38A'–38E'. By feeding each spreader tray, e.g., 32A from two opposing sides (ports 38A and 38A), the particulate material collides approximately in the center of each tray 32A and is distributed more evenly across each spreader tray 32A. That is, the particulate material that has collided as a result of the opposing inlet feed rebounds and disperses across each tray 32A. As noted above, adjustment to the flow of the particulate material to inlet ports 38A–38E and 38A'–38E' (and therefore each respective spreader tray 32A–32E) can optionally be made with a flow control system. The particulate material flow can thus be balanced to allow the particle collision to reach a specific location on each tray 32A–32E and magnitude that is suitable for the particular sizing and separating application.

The particles are retained on each spreader tray 32A by a lip 52, causing the particles to be encouraged by the vibration of screen box 22 to fall through the perforations (not shown) defined in spreader tray 32A to respective screen 30A below. In this manner, each spreader tray 32A–32E provides a rainfall-like distribution of particulate material on each respective screen 30A–30E. This creates a smooth transition and even distribution of the feed slurry on the surface of each screen 30A–30E, and also results in longer life of the screens.

As motors 26 of motor assembly 24 continue to provide a high frequency linear stroke vibrating motion to frame 12 and associated screen box 22, the particulate material is moved along screens 30A–30E. Undersize particles, i.e., particles that are able to pass through the mesh of screens 30A–30E, drop along with liquid into a pan 54 that is disposed directly beneath each screen 30A–30E. Thus, a pan 54A–54E that corresponds to each screen 30A–30E is disposed below each screen 30A–30E.

Each pan 54A–54E is shaped to direct the undersize particles and liquid to a discharge system 56, such as a tube, pipe or similar hollow conveyance apparatus. Reference herein will be made to discharge system 56 as a tube as an example. Each pan 54A–54E is in fluid communication with tube 56 to allow the undersize particles and liquid to pass through. Once in tube 56, the undersize particles and liquid are conveyed away from the apparatus 10. Of course, more than one discharge tube 56 may be employed, as two are shown, and each pan 54A–54E will be shaped accordingly to direct the undersize particles to each tube 56 as dictated by the particular sizing operation.

Particulate material that is too large to drop through the mesh of screens 30 moves along the surface of each screen 30A–30E, due to the vibratory motion described in detail above, starting from a feed end of each screen 60A–60E. Since screens 30A–30E are secured to opposing sides 34 and 36 of the screen box 22, the oversize particulate material stays on the surface of each screen 30A–30E until it reaches a terminal end 62A–62E of each screen. At terminal end 62A–62E of each screen 30A–30E, the shape of each pan 54A–54E creates a gap 64 between pans 54A–54E and a corresponding end wall 66 of screen box 22. Gap 64 is defined by the end of each pan 54A–54E, corresponding end wall 66 of screen box 22 and undersize material discharge system 56.

Each pan 54A–54E may extend slightly beyond terminal end 62 of each corresponding screen 30A–30E, but includes a cover 68 over this portion to prevent any oversize particles from dropping into pans 54A–54E. Thus, once oversize material reaches the terminal end of each screen 30A–30E, it drops off each respective screen 30A–30E into gap 64. Referring back to FIG. 2, the material falls to a hopper 70 at the bottom of screen box 22. Hopper 70 defines an outlet 72 through which the oversize particles pass to be conveyed away from apparatus 10 separately from the undersize particles.

Figure 6:
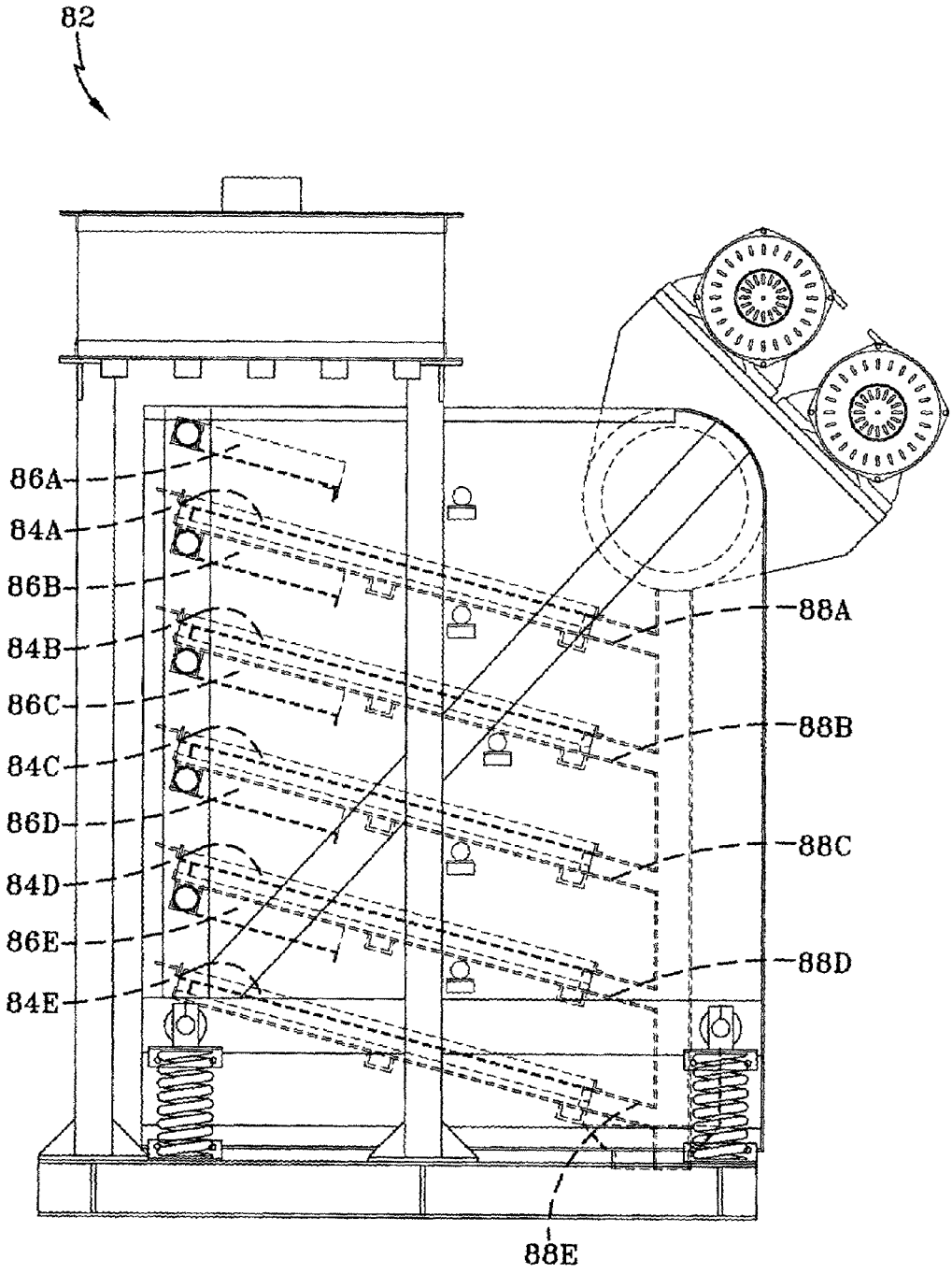
FIG. 6 is an elevational side view of a second embodiment of the present invention, with hidden parts represented by broken lines.

With reference to FIG. 6, another embodiment of the present invention is shown and is indicated generally at 82. While the embodiment illustrated in FIGS. 1–5 includes screens 30A–30E that are oriented at about zero degrees relative to horizontal, the screens may take on different orientations as dictated by the particular screening application. For example, screens 84A–84E may be oriented at an angle of about fifteen degrees relative to horizontal. Accordingly, the angle of each respective spreader tray 86A–86E and pan 88A–88E will be oriented at fifteen degrees. However, the components and manner of feeding the screens 84A–84E, as well as discharge of the separated undersize particles, oversize particles and liquid, remains the same as described above.

It should also be noted that lesser angles, such as those under fifteen degrees relative to horizontal, may be effected by using spacers for each screen, or inserting a spacer beneath the suspension means.

In the exemplary illustrated embodiments, the five parallel screens 30A–30E and 84A–84E increase the processing capacity of sizing and separating apparatus 10 and 82 from about 2.5 to about 4 times of that found in prior art single- or double-screen sizing and separating apparatus. In addition, apparatus 10 and 82 of the invention is very compact relative to traditional single and double screen apparatus. However, the concepts described herein apply to any number of screens and/or orientation of screens, as well as any number and/or orientation of motor assemblies. In addition, the concepts herein apply to similar arrangements of the components, such as a distributor that is mounted apart from the base.

Thus, it can be seen that the present invention solves the problems of size and capacity heretofore left unsolved by prior attempts to construct a multiple screen sizing and separating apparatus for processing wet fine particles, wherein the screens are vertically arranged. This problem-solving result is achieved through the unique structure and process employed to feed and distribute the material onto the screens 30A–30E and 84A–84E, via opposed side inlet ports 38A–38E and 38A'–38E' and onto perforated spreader trays 32A–32E. The result is a relatively high capacity, compact sizing and separating apparatus 10 and 82.

Accordingly, the wet fine particle sizing and separating apparatus is simplified, provides an effective, safe, inexpensive, and efficient article which achieves all the enumerated objectives, provides for eliminating difficulties encountered with prior sizing apparatus, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the wet fine particle sizing and separating apparatus is used and installed, as well as the characteristics of the construction and arrangement, and the advantageous, new and useful results obtained; the new and useful structures, devices, elements, arrangements, parts and combinations are set forth in the appended claims.

What is claimed is:

1. An apparatus for the sizing and separating of particles, comprising:

a base;

a frame mounted on the base by suspension means;

a motor assembly attached to the frame for vibrating the apparatus;

a screen box mounted on the frame;

at least two screens disposed within and secured to the screen box;

a spreader tray for each screen, wherein each spreader tray is disposed above each respective screen in the screen box;

at least two inlet ports defined in opposing sides of the screen box for each spreader tray proximate each respective spreader tray;

a distributor proximate the screen box;

means for connecting the distributor to the inlet ports, whereby particles are conveyed from the distributor to the inlet ports and on to the spreader trays;

a pan for each screen, wherein each pan is disposed in the screen box underneath each respective screen to receive particles that pass through the screens;

at least one tube in fluid communication with the pans to convey undersize particles away from the apparatus; and a hopper at a lower end of the screen box that defines an outlet to receive and convey particles that pass over the screens away from the apparatus.

2. The apparatus of claim 1, wherein the screens are secured to the screen box in a vertically aligned spaced parallel manner.

3. The apparatus of claim 1, wherein the distributor defines an outlet port for each inlet port defined in the screen box.

4. The apparatus of claim 1, wherein the means for connecting the distributor to the inlet ports include a hose.

5. The apparatus of claim 1, wherein the spreader tray defines perforations.

* * * * *